US008540245B2

(12) United States Patent
Rasmussen

(10) Patent No.: US 8,540,245 B2
(45) Date of Patent: Sep. 24, 2013

(54) REEL STRIP ATTACHMENT

(75) Inventor: James M. Rasmussen, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 2323 days.

(21) Appl. No.: 11/199,008

(22) Filed: Aug. 8, 2005

(65) Prior Publication Data

US 2007/0032293 A1 Feb. 8, 2007

(51) Int. Cl.
*A63F 7/02* (2006.01)

(52) U.S. Cl.
USPC ..... 273/143 R; 273/292; 441/133

(58) Field of Classification Search
USPC ..... 463/16, 20; 273/143 R
See application file for complete search history.

(56) References Cited

U.S. PATENT DOCUMENTS

| | | | | |
|---|---|---|---|---|
| 4,621,815 | A * | 11/1986 | Yamamoto | 273/143 R |
| 4,874,172 | A * | 10/1989 | Nakamura | 273/143 R |
| 6,102,396 | A * | 8/2000 | Liu | 273/143 R |
| 6,331,129 | B1 * | 12/2001 | Earley | 441/133 |
| 7,316,395 | B1 * | 1/2008 | Kromydas | 273/143 R |
| 2003/0062682 | A1 * | 4/2003 | Kato | 273/292 |

FOREIGN PATENT DOCUMENTS

| | | | |
|---|---|---|---|
| GB | 2 212 645 | | 7/1989 |
| GB | 2 256 073 | | 11/1992 |
| JP | 2002119677 | A * | 4/2002 |

OTHER PUBLICATIONS

"Replacing and Aligning A Reel Strip" WMS Service Manual—Upright Slot 16-004341—Periodic Maintenance (approx. 1995-1996); 4 pages.
"Reel Strip and Opto Strip Replacement" WMS Gaming Service Manual—Chapter 6: Maintenance (Jan. 2005); 13 pages.
Search Report Under Section 17 for U.K. Application No. GB0614959.5 dated Nov. 22, 2006 (1 page).

* cited by examiner

*Primary Examiner* — Melba Bumgarner
*Assistant Examiner* — Frank M Leiva
(74) *Attorney, Agent, or Firm* — Nixon Peabody LLP

(57) ABSTRACT

A releasable reel strip attachment assembly including an attachment strip with snap rivets that snaps through corresponding apertures in a reel strip and into apertures in a reel cage. The attachment strip includes an adhesive layer protected by a release backing that is removed to expose the adhesive layer. The reel strip is positioned over the reel cage so that the apertures in the reel strip co-align with those of the reel cage, and the snap rivets are inserted through the aligned apertures to attach the reel strip to the reel cage in a reliable, precise, and consistent manner. The reel strip is wound around the reel cage and the free end of the reel strip is pressed onto the exposed adhesive layer of the attachment strip.

16 Claims, 8 Drawing Sheets

REEL STRIP ATTACHMENT

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to attachment assemblies, and more particularly, to a reel strip attachment and method.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

Gaming machines have utilized a variety of mechanisms to present various combinations of symbols, and to award prizes, money, or other awards associated with certain predefined winning combinations. Traditional slot machines, for example, utilize a plurality of reels (either mechanical, or simulated on a video display) and at least one payline, with certain combination of symbols landing on the payline constituting winning combinations for which awards are given to the player in accordance with a pay table.

Some existing slot machines with mechanical reels have removable reel strips to allow operators to replace worn strips or install new strips with different artwork. One replacement approach involves use of an adhesive tape to secure one end of the strip to the cage of a reel mechanism and another end of the strip to itself. This approach suffers from numerous disadvantages. Strip removal can be destructive or damaging to the strip because the adhesive, especially over time, forms a very tight bond. As a result, strip removal usually causes tears or kinks in the strip as the stubborn adhesive reluctantly yields to the exerting force by the operator. The reel strip must then be discarded and cannot be reused. Snap rivets with caps are also utilized, leaving visually unappealing caps visible to the player. For example, if the reel stops at a symbol near the connection point of the two ends of the reel strip, the rivet caps are visible to the player, destroying the perception of a seamless reel.

Another disadvantage is that when installing a new reel strip the operator must align the bottom of the new reel strip with a specific location on the reel cage by "eyeballing" the precise alignment position. This subjective alignment technique is fraught with human error, and can result in a misalignment of the reel strip relative to the cage, causing player confusion about whether a symbol is on a payline or not. This technique can also be somewhat time consuming depending upon the number of reels that need to be serviced.

Thus, a need exists for an improved apparatus and method. The present invention is directed to satisfying one or more of these needs and solving other problems.

SUMMARY OF THE INVENTION

According to one aspect of the present invention, an assembly includes a frame, a strip, and an attachment strip. The frame has a registration aperture in an outer surface of the frame. The strip also has an aperture positioned to co-align with the registration aperture. The attachment strip has an adhesive layer on one side thereof and at least one protruding member, which can be a snap rivet, positioned to co-align with the registration aperture and to secure the strip to the frame. The reel strip may further include a release backing to expose the adhesive layer when removed. The assembly may be used in a gaming device that displays a wagering game in response to receiving a wager from a player. In an embodiment, the strip has a bottom edge and a top edge, where the aperture is positioned proximate the bottom edge and the adhesive layer is proximate the top edge when the strip is secured to the frame.

According to another aspect of the present invention, an assembly includes a frame and a strip. The frame has a brace that includes a recess angled toward an alignment edge of the brace. The strip has a first end received in the recess and a second end having an adhesive layer on an edge portion of the second end opposing the first end. The second end of the strip is secured to the first end by the adhesive layer. The recess has a height that is at least the value of the thickness of the strip.

In alternate embodiments, any of the foregoing may further be present in the foregoing assembly. The edge portion of the first end opposing the recess may include an adhesive layer. The assembly may further include a protrusion, such as a nub, in the recess. The first end of the strip has a corresponding aperture dimensioned to engage the protrusion, and optionally there is an adhesive layer on an edge portion of the first end opposing the recess. The protrusion is concealed by the second end when it is secured over the first end. The protrusion may further include a pin member and a cap member that extends beyond the pin member in a direction away from the first end of the reel strip.

According to still another aspect of the present invention, a method of releasably attaching a reel strip to a reel mechanism includes aligning an aperture of the reel strip with a corresponding registration aperture formed in the reel mechanism. The method further includes fastening one end of the reel strip to the reel mechanism with an attachment assembly having a strip affixed to an attachment mechanism. The method further includes winding the reel strip around the reel mechanism and securing the free end of the reel strip to an adhesive layer on the strip of the attachment assembly.

The method may further include removing a release backing from the strip to reveal the adhesive layer. The method may further include detaching the reel strip from the reel mechanism by releasing the attachment strip from the reel mechanism. The method may still further include attaching one end of a second reel strip to the reel mechanism with a second attachment assembly having a second strip affixed to an attachment mechanism, winding the second reel strip around the reel mechanism, and securing the free end of the second reel strip to an adhesive layer on the second strip.

The reel mechanism may include a reel cage, and no part of the reel strip may be directly adhered to any other part of the reel strip. The securing may result in the free end of the reel strip lying generally flush against the reel strip. The method may further include orienting, prior to attaching the reel strip to the reel mechanism, the reel strip to be in a display-viewable direction.

Additional aspects of the invention will be apparent to those of ordinary skill in the art in view of the detailed description of various embodiments, which is made with reference to the drawings, a brief description of which is provided below.

DETAILED DESCRIPTION

Figure 1:
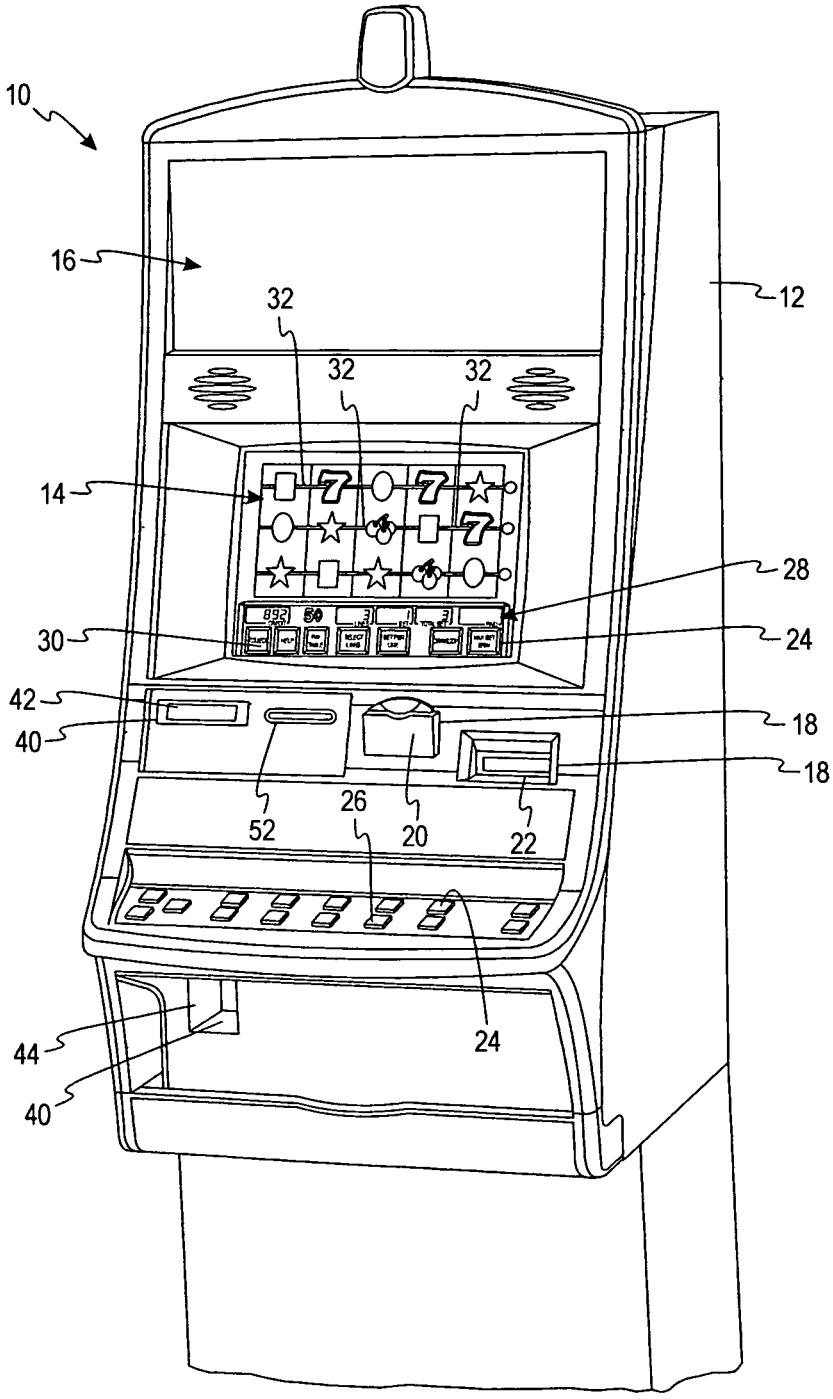
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual associated to at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
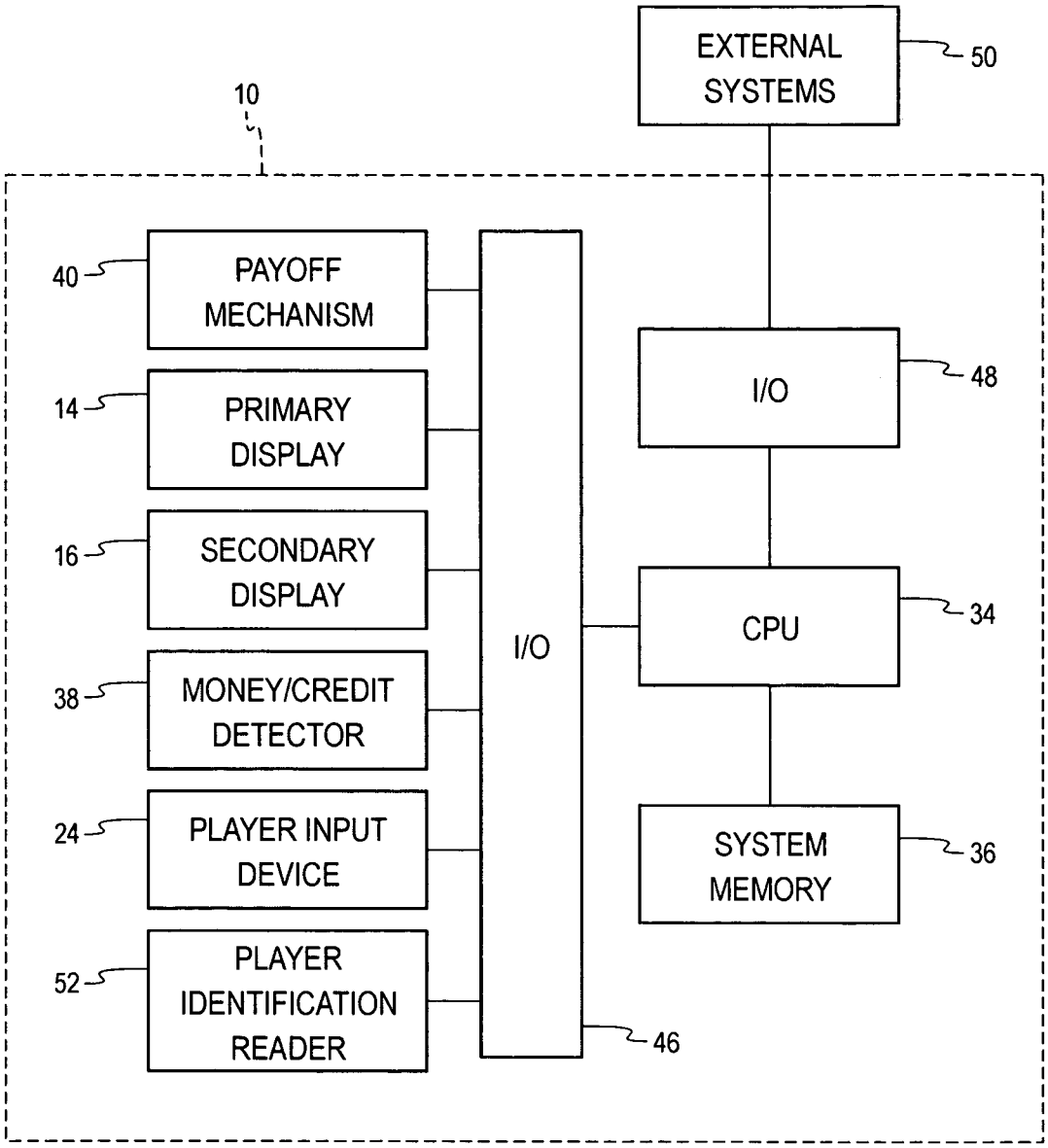
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10 bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

As mentioned above, the gaming machine 10 may be an electromechanical gaming machine configured to play mechanical slots. The primary display 14 includes a number of mechanical reels to display the outcome, and these mechanical reels conventionally include a reel drum or cage about which a reel strip bearing artwork (i.e., symbols) is wound. If the gaming machine 10 includes three reels, then there are three such reel strips wound around three separate reel cages. For five reels, five strips are required, and so on. The present invention pertains, inter alia, to the manner in which the reel strip is attached to the reel cage.

Figure 3:
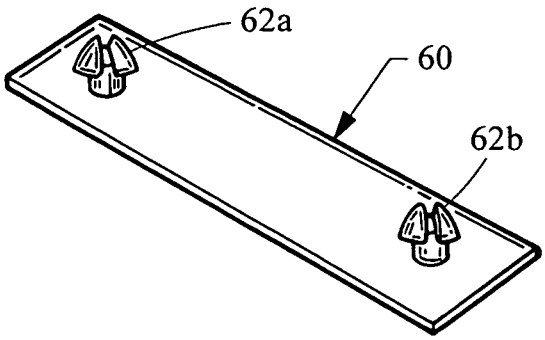
FIG. 3 is a bottom perspective view of an attachment strip according to an embodiment of the present invention.
Figure 4:
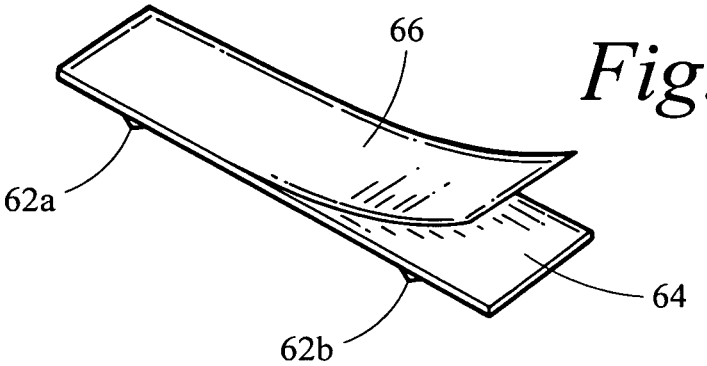
FIG. 4 is a top perspective view of the attachment strip shown in FIG. 3.

Turning now to FIG. 3, there is shown a bottom view of an attachment strip 60 with two snap rivets 62*a*, 62*b*, according to an embodiment of the present invention. The attachment strip 60 is preferably made of a thin, flexible material such as plastic. In a specific embodiment, the attachment strip 60 has a thickness of approximately 0.015 inches, and has a width of approximately 0.25 inches and a length of approximately three inches. The thickness of the attachment strip 60 should sufficiently thin to create as much as possible a visual perception of a seamless reel strip and sufficiently thick to hold the snap rivets 62*a,b* securely. On the top of the attachment strip 60, shown in FIG. 4, there is an adhesive layer 64 protected by a removable release backing 66 that, when removed, exposes the adhesive layer 64.

Figure 5:
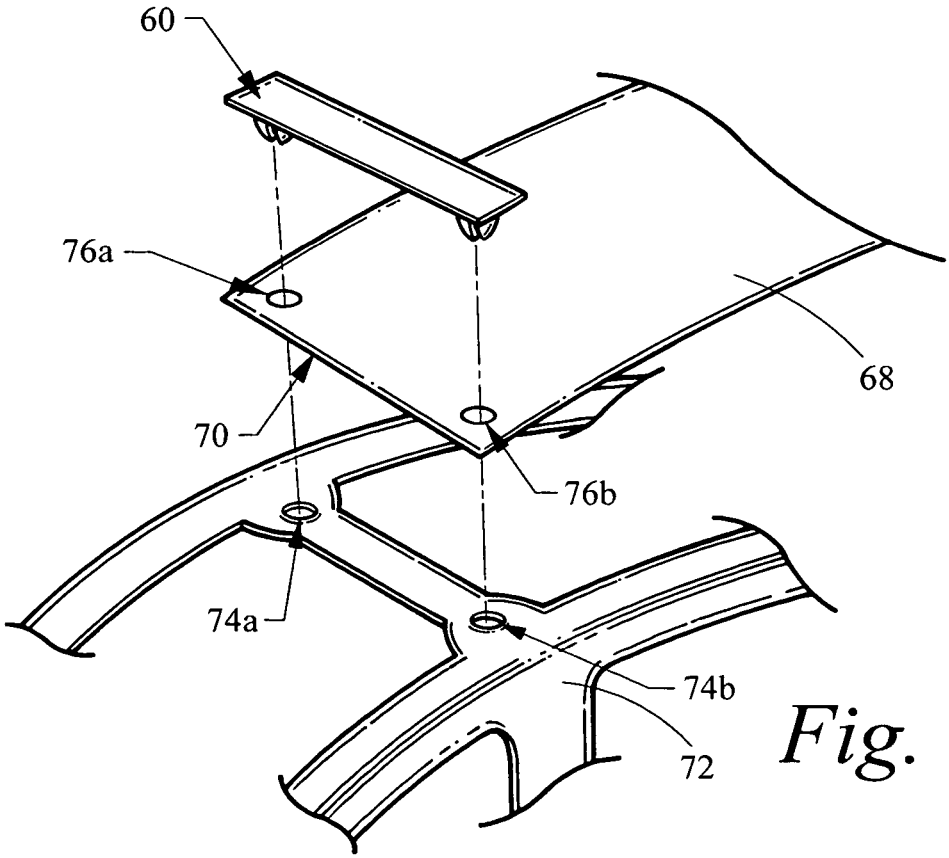
FIG. 5 is an exploded partial cutaway perspective view of the attachment strip shown in FIGS. 3 and 4 attaching a reel strip to a reel cage according to an embodiment of the present invention.

A reel strip 68 shown in FIG. 5 includes two apertures 76*a*, 76*b* that are positioned to co-align with the snap rivets 62*a*, 62*b*, respectively. A reel cage 72 has two registration apertures 74*a*, 74*b* formed in the reel cage 72 frame, and the apertures 74*a*, 74*b* receive the snap rivets 62*a*, 62*b*, respectively. To attach the reel strip 68 to the reel cage 72, the operator aligns the bottom edge 70 of the reel strip 68 such that the apertures 76*a*, 76*b* align with the registration apertures 74*a*, 74*b*, respectively. The snap rivets 62*a*, 62*b* of the attachment strip 60 are inserted through the apertures 76*a*, 76*b* of the reel strip 68 and the registration apertures 74*a*, 74*b* of the reel cage 72 to attach the reel strip 68 to the reel cage 72. The snap rivets 62*a,b* and the registration apertures 76*a,b* permit the operator to align the reel strip 68 precisely in position on the reel cage 72 without having to eyeball or use subjective judgment as to the location of the precise alignment position.

Figure 6:
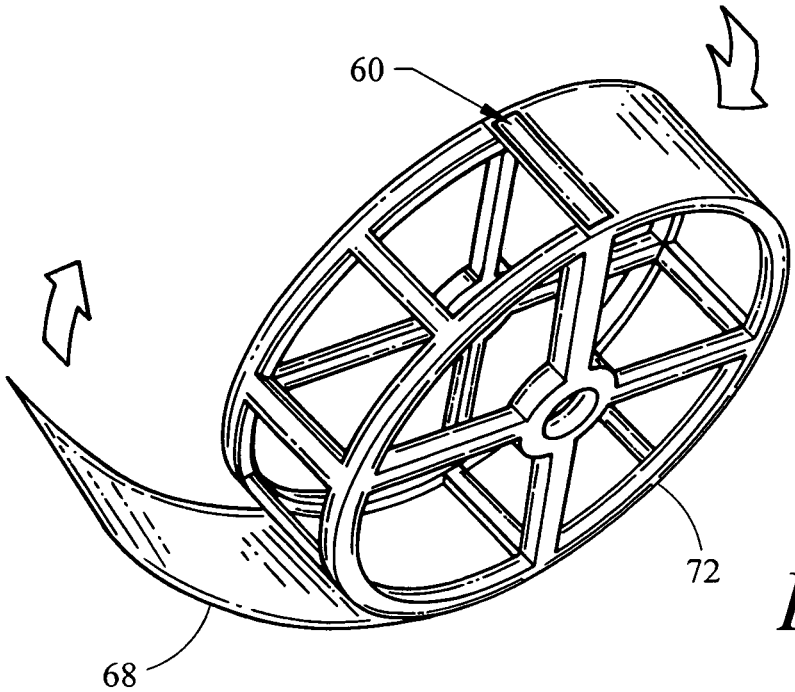
FIG. 6 is a perspective view of the reel cage shown in FIG. 5 with a reel strip partially wound around the reel cage.
Figure 7:
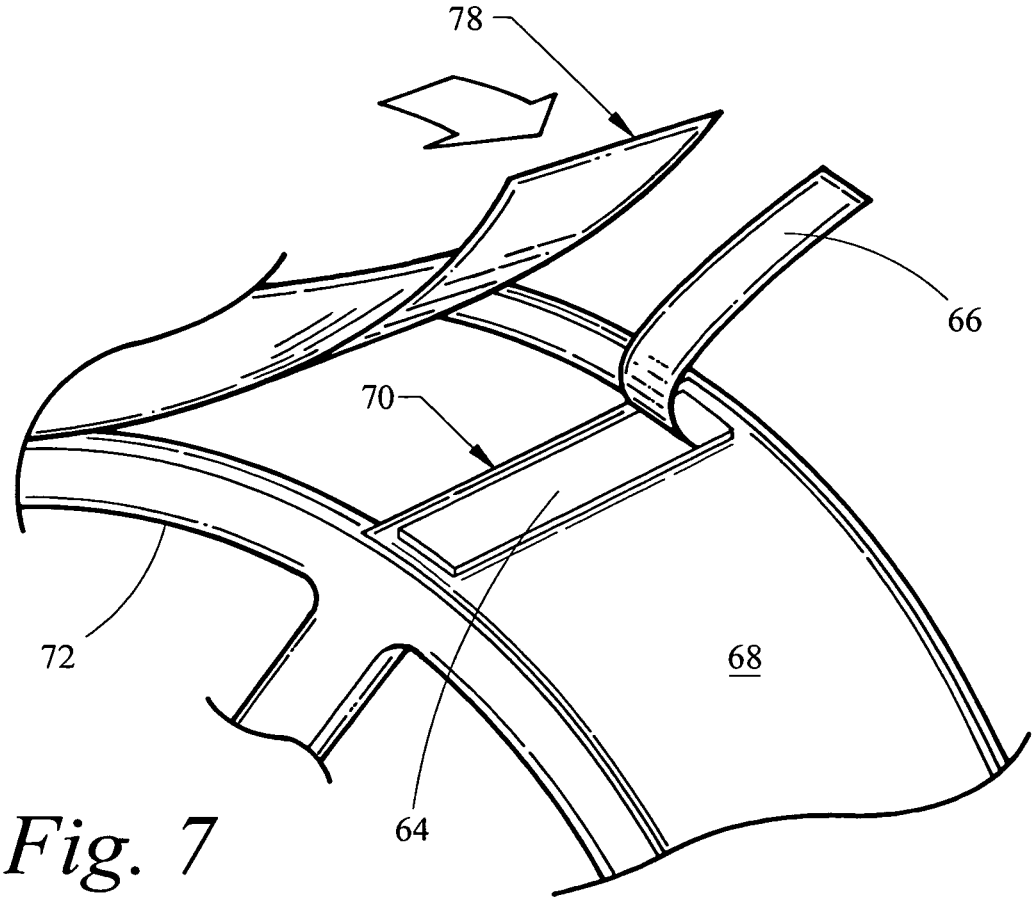
FIG. 7 is a partial perspective cutaway view of the reel strip shown in FIGS. 5 and 6 just prior to its attachment to an adhesive layer on the attachment strip.

Once attached to the reel cage 72, the reel strip 68 is wound around the reel cage 72 in a manner shown in FIG. 6. The operator must take care to ensure that the symbols are oriented in a display-readable direction. The snap rivets 62*a,b* attached to the reel cage 72 maintain the bottom edge 70 of the reel strip 68 in the proper position as the reel strip 68 is wound around the reel cage 72. As shown in FIG. 7, the release backing 66 is removed from the attachment strip 60 to expose the adhesive layer 64. A top edge 78 of the reel strip 68 is pressed onto the adhesive layer 64 to adhere the strip area proximate the top edge 78 to the attachment strip 60. In the embodiment shown in FIGS. 3-7, no part of the reel strip 68 is directly adhered to any other part of the reel strip 68. To remove the reel strip 68, the operator simply releases the snap rivets 62*a,b* from the interior of the reel cage 72, thereby freeing the reel strip 68. This removal process is advantageously non-destructive to the reel strip 68, which can be reused if desired, and to the reel cage 72. In addition, when installed, the attachment strip 60 is entirely concealed from the player. Thus, the embodiment shown in FIGS. 3-7 provides a positive, repeatable location for aligning the reel strip 68 into proper position on the reel cage 72, a non-destructive attachment means that insures the integrity of the reel strip 68 and reel cage 72 alike, and a virtually seamless connection between the two ends of the reel strip 68 that leaves no visually unappealing artifacts on the surface of the reel strip 68.

Figures 8, 9:
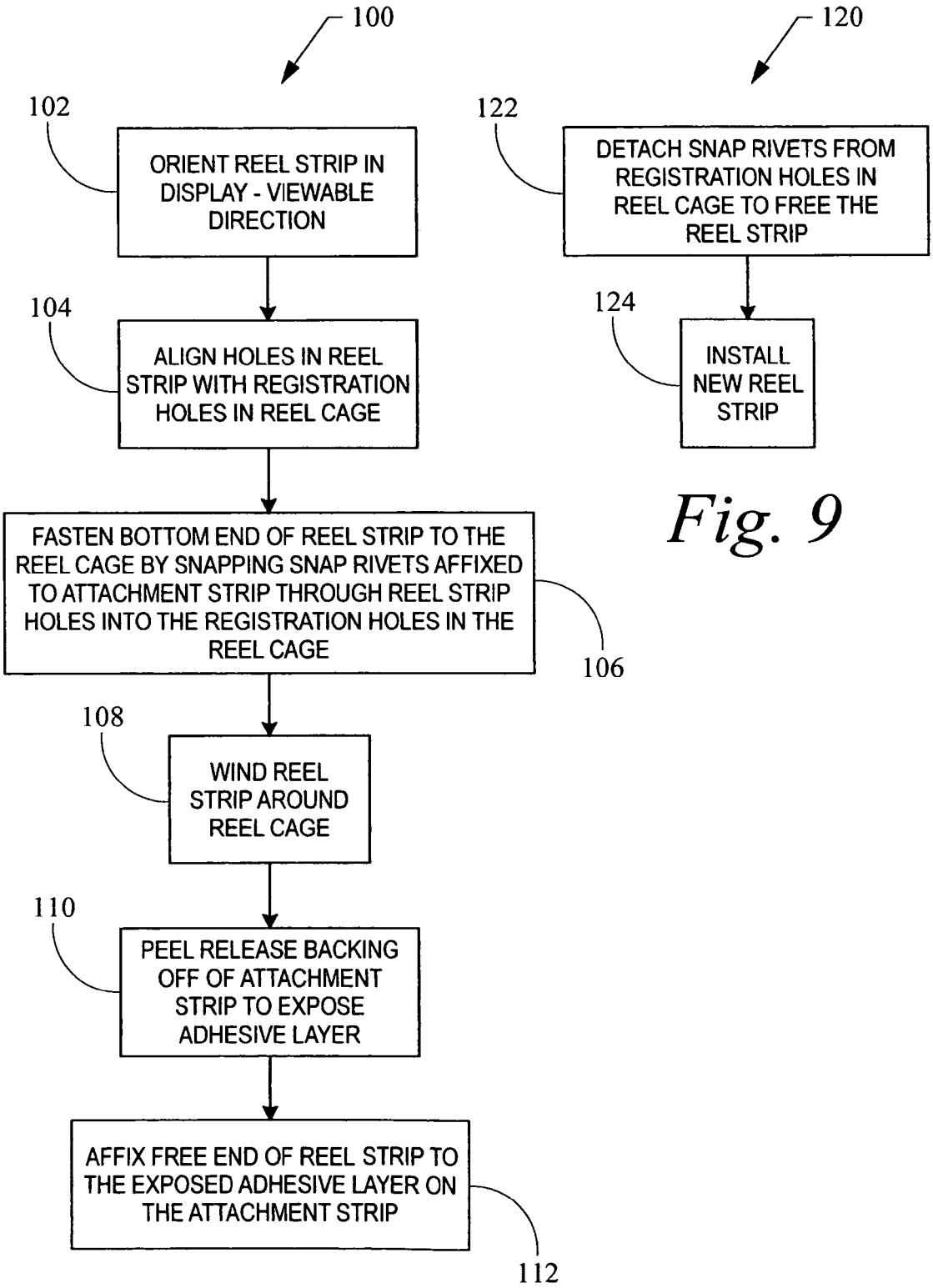
FIG. 8 is a flowchart of a method of attaching a reel strip according to an embodiment of the present invention.
FIG. 9 is a flowchart of a method of detaching a reel strip according to an embodiment of the present invention.

Turning now to FIG. 8, a flowchart of a method (100) of attaching a reel strip according to an embodiment of the present invention is shown with reference to FIGS. 3-7. The arrangement of the blocks 102-112 does not necessarily denote a particular order that must be followed. The reel strip 68 is oriented in a display-viewable direction (102) such that the symbol artwork when the reel cage 72 rotates is displayed to the player right-side up. The apertures 76*a,b* in the reel strip 68 are aligned with the registration apertures 74*a,b* in the reel cage 72 (104). The bottom end 70 of the reel strip 68 is fastened to the reel cage 72 by snapping the snap rivets 62*a,b* through the apertures 76*a,b* into the registration apertures 74*a,b* (106). The reel strip 68 is wound around the reel cage (108). The release backing 66 is peeled off of the attachment strip 60 to expose the adhesive layer 64 (110). The free end 78 of the reel strip 68 is affixed to the exposed adhesive layer 64 (112), securing the reel strip 68 to the reel cage 72 in a registered, properly aligned, and precise way.

FIG. 9 illustrates a flowchart of a method (120) of installing a new reel strip according to an embodiment of the present invention. The snap rivets 62*a,b* are detached from the corresponding registration apertures 74*a,b* in the reel cage 72 to free to reel strip 68 therefrom (122). A new reel strip (not shown) is installed (124) in accordance with the procedure associated with FIG. 8. Removal is simple, non-destructive to the reel strip 68 and to the reel cage 72, and repeatable in that the same reel strip 68 that is removed from the reel cage 72 can be re-installed and removed again from another reel cage.

Figure 10A:
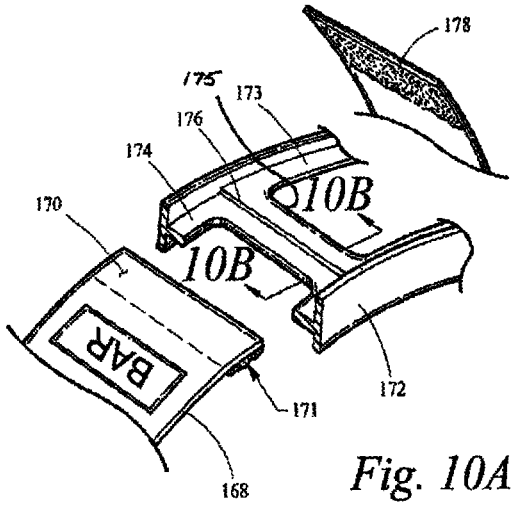
FIG. 10A is a perspective view of a portion of an attachment assembly in accordance with an embodiment of the present invention.

FIG. 10A is a perspective view illustration of an attachment assembly in accordance with an embodiment of the present invention. A reel cage 172 includes a horizontal brace 175 that includes a recess 174 that terminates at an alignment edge 176. The recess 174 receives a flap portion 170 of a reel strip 168. On the underside of the flap portion 170 is a layer of adhesive 171 that adheres to the recess 174. The operator aligns the end of the flap portion 170 with the alignment edge 176, and then applies pressure to the top of the flap portion 170 to adhere the underside thereof to the recess 174 of the horizontal brace 175 of the reel cage 172. The alignment edge provides a positive, repeatable location for aligning the bottom end of the reel strip 168 into proper position. No more careful, time-consuming "eyeballing" on the part of the operator is required; once the reel strip 168 is flush against the alignment edge 176, the operator continues with the installation.

Figure 10B:
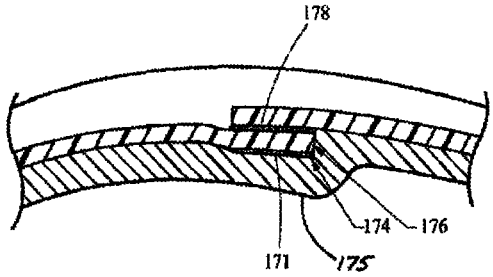
FIG. 10B is a side cutaway view of the attachment assembly shown in FIG. 10A.

The reel strip 168 is wound around the reel cage 172 so that the artwork symbols are oriented in a display-readable direction. The free end of the reel strip 168 has an adhesive layer 178 disposed on its underside, which is secured to the top of the flap portion 170 as shown in FIG. 10B (taken along lines 10B-10B of FIG. 10A). The bottom end of the reel strip 168 abuts the alignment edge 176 and is held in position there by the an adhesive layer 171. The top end of the reel strip 168 is secured to the bottom end by the adhesive layer 178.

The height of the alignment edge 176 is dimensioned to be at least the size of the thickness of the reel strip 168, which conventionally ranges from between 0.010 inches to 0.025 inches. Thus, the top or free end of the reel strip 168 is substantially flush with the bottom end of the reel strip 168 when installed, reducing visual artifacts apparent to the player when the reel strip is spinning. To the player, the reel strip 168 appears to be a seamless, continuous reel without any unattractive visual artifacts such as rivet heads or the like. The attachment assembly of FIGS. 10A and 10B can be thought of as invisible in the sense that no rivets or other artifacts are visible on the exposed surface of the wrapped reel strip. No apertures are formed in the reel strip, which simplifies its construction.

Figure 11:
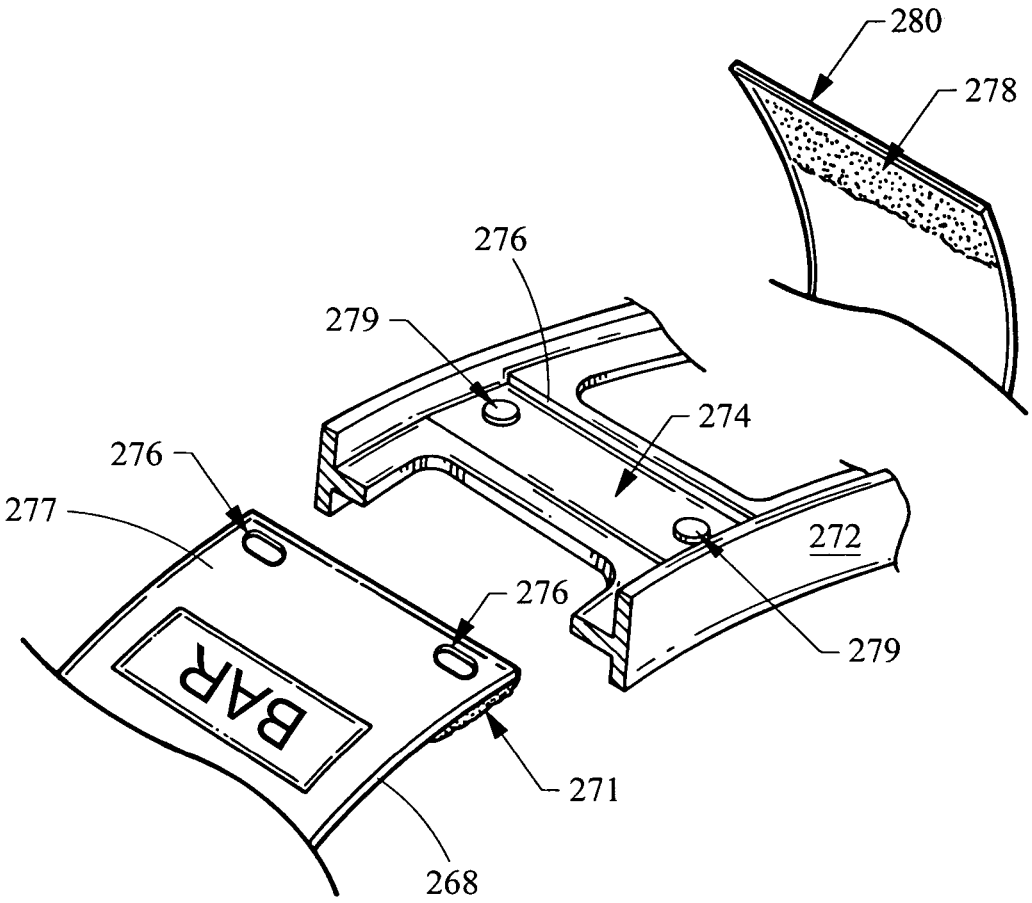
FIG. 11 is a perspective view of a portion of an attachment assembly in accordance with another embodiment of the present invention.

In another embodiment of the present invention, nubs are introduced to retain the bottom edge of the reel strip. FIG. 11 illustrates a perspective view of an attachment assembly having nubs 279 formed in a recess 274 of a reel cage 272. The recess 274 terminates in an alignment edge 276 having a height approximately the size of the thickness of a reel strip 268. The bottom edge portion 277 of the reel strip 268 has corresponding apertures 276 that are received by the nubs 279. To install the reel strip 268, the operator aligns the apertures 276 over the nubs 279 and applies pressure to the bottom edge portion 277, which is optionally secured to the recess 274 by an adhesive layer 271 disposed on the underside of the bottom edge portion 277. The bottom end of the bottom edge portion 277 abuts against the alignment edge 276. The top end of the reel strip 268 is secured to the bottom edge portion 277 by an adhesive layer disposed on the underside of a top end portion 280 of the top end, thus concealing the nubs 279. The nubs 279 and the alignment edge 276 provide a positive, repeatable location for the reel strip 268. As mentioned above, the adhesive layer 271 is optional, and in an embodiment, no adhesive layer 271 is provided, thus requiring half of the adhesive required for the embodiment shown in FIGS. 10A and 10B.

In an embodiment, the apertures 276 are in the shape of slots that are slightly wider than the rounded nubs 279. The slotted shape of the apertures 276 reduces tolerance required between their centers, allowing for some "play" when positioning the bottom end of the reel strip 268 in place against the alignment edge 276.

Figure 12A:
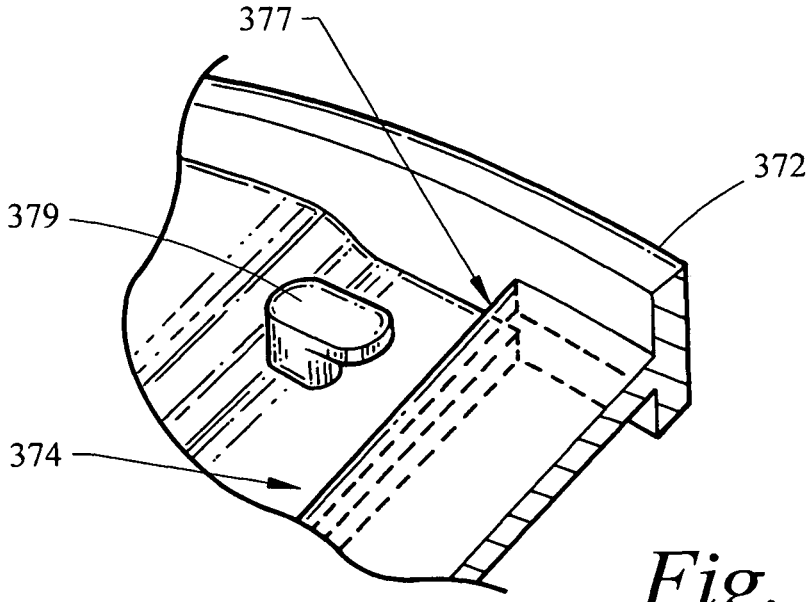
FIGS. 12A and 12B are perspective views of a portion of an attachment assembly in accordance with still another embodiment of the present invention.
Figure 12B:
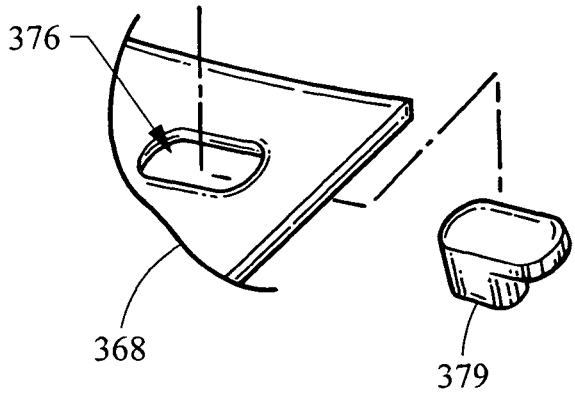

FIGS. 12A and 12B are a perspective illustration of a cutaway portion of an attachment assembly according to an embodiment of the present invention. Here, pins with overhanging caps are provided to secure the bottom end of a reel strip 368 to a reel cage 372 without the use of an adhesive layer on the underside of the bottom end of the reel strip 368. An aperture 376 in the reel strip 368 is dimensioned to receive the cap portion of a pin 379 that is disposed in a recess 374 that terminates at an alignment edge 377 of the reel cage 372. The bottom end of the reel strip 368 is secured to the reel cage 372 by hooking the aperture 376 over the pin 379. As the reel strip 368 is wound around the reel cage 372, the pulling action of the reel strip 368 causes the aperture 376 to hook over the cap portion of the pin 379 and be held there in tension against the pin 379. The top end of the reel strip 368 (not shown) is secured to the bottom end portion by an adhesive layer disposed along a top end area of the reel strip 368, concealing the cap portion of the pin 379.

Figure 13:
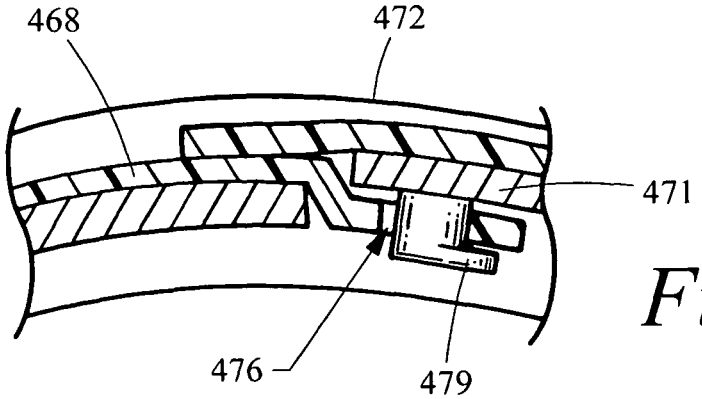
FIG. 13 is a side cutaway view of a portion of an attachment assembly in accordance with yet another embodiment of the present invention.

In still another embodiment shown in FIG. 13, a pin 479 is projected downward from the underside of a horizontal brace 471 of a reel cage 472. The bottom end of a reel strip 468 includes an aperture 476 dimensioned to fit over the cap portion of the pin 479, which is held in tension when the reel strip 468 is installed. A top end portion of the reel strip 468 is secured to the exposed bottom end portion by an adhesive layer disposed on the underside of the top end portion. As with the embodiment shown in FIGS. 12A and 12B, no adhesive layer is required on the bottom end portion of the reel strip 468 or the reel strip 368. The cap portion of the pin 479 or pin 379 prevents the reel strip 468 or reel strip 368 from slipping out of place.

Each of these embodiments and obvious variations thereof is contemplated as falling within the spirit and scope of the claimed invention, which is set forth in the following claims.

What is claimed is:

1. A reel cage comprising:

a frame having at least one registration aperture;

a reel strip having at least one reel strip aperture positioned to co-align with said at least one registration aperture;

an attachment strip having an adhesive layer on one side and an opposite, non-adhesive side having at least one protruding member extending from said non-adhesive side, wherein said at least one protruding member is positioned to pass through said at least one reel strip aperture to engage said at least one registration aperture such that said attachment strip secures said reel strip to said frame; and wherein said reel strip winds around said frame to contact said adhesive layer.

2. The reel cage of claim 1, wherein said reel strip further includes a release backing, the release backing being removable to expose said adhesive layer.

3. The reel cage of claim 1, wherein said frame has a first registration aperture and a second registration aperture, said reel strip has a first reel strip aperture and a second reel strip aperture, said attachment strip has a first protruding member and a second protruding member, and said first protruding member and said second protruding member are positioned to pass through said first and second reel strip apertures, respectively, to engage said first and second registration apertures.

4. The reel cage of claim 1, wherein said frame has a substantially circular shape; and said reel strip has a length at least equal to a circumference of said frame.

5. The reel cage of claim 1, wherein said protruding member is a snap rivet.

6. The reel cage of claim 1, said reel strip having a bottom edge and a top edge, said at least one reel strip aperture being positioned proximate said bottom edge, said adhesive layer of said attachment strip being proximate said top edge when said strip is secured to said frame.

7. The reel of claim 3, wherein said attachment strip secures said reel strip to said frame while aligning said reel strip circumferentially on said frame.

8. A method of releasably attaching a reel strip to a reel cage, the method comprising:

aligning a reel strip aperture of said reel strip with a corresponding registration aperture of a frame of said reel cage;

fastening one end of said reel strip to said reel cage with an attachment strip, said attachment strip having an adhesive layer fixed to one side and at least one protruding member fixed to and extending from a non-adhesive, opposite side, said protruding member being positioned to pass through said reel strip aperture to engage said registration aperture; and winding said reel strip around said reel cage to contact said adhesive layer.

9. The method of claim 8, further comprising removing a release backing from said attachment strip to reveal said adhesive layer.

10. The method of claim 8, further comprising detaching said reel strip from said reel by disengaging said protruding member from said registration aperture.

11. The method of claim 10, further comprising:

fastening one end of a second reel strip to said reel cage with a second attachment strip, said second attachment strip having an adhesive layer on one side and an opposite, non-adhesive side having at least one protruding member extending from said non-adhesive side, wherein said at least one protruding member is positioned to pass through said second reel strip to engage said reel cage; and winding said second reel strip around said reel cage to contact said adhesive layer on said second attachment strip.

12. The method of claim 8, wherein said reel strip has a bottom edge and a top edge, said reel strip aperture being positioned proximate said bottom edge, and said adhesive layer of said attachment strip being proximate said top edge when said reel strip is wound around said reel cage to contact said adhesive layer.

13. The method of claim 12, wherein only one of said bottom edge and top edge is adhesively-connected to the attachment strip.

14. The method of claim 8, wherein said securing results in the free end of said reel strip lying generally flush against said reel strip.

15. The method of claim 8, further comprising, prior to said attaching, orienting said reel strip to be in a display-viewable direction.

16. The method of claim 8, further comprising installing said reel cage into a gaming device that displays a wagering game in response to receiving a wager from a player.

* * * * *